United States Patent [19]

Yu

[11] B 3,984,193

[45] Oct. 5, 1976

[54] RADIAL-FLOW TURBOMACHINE

[75] Inventor: Mason K. Yu, Birmingham, Mich.

[73] Assignee: General Motors Corporation, Detroit, Mich.

[22] Filed: Oct. 7, 1974

[21] Appl. No.: 512,547

[44] Published under the second Trial Voluntary Protest Program on January 13, 1976 as document No. B 512,547.

[52] U.S. Cl. ..... 415/213 R; 415/219 C; 416/185

[51] Int. Cl.[2] ..... F04D 17/00

[58] Field of Search ..... 415/213 R; 416/185, 416/192, 219 C

[56] References Cited

UNITED STATES PATENTS

| | | | |
|---|---|---|---|
| 929,230 | 7/1909 | Landrum et al. | 415/213 R |
| 1,149,904 | 8/1915 | Foster | 415/213 R |
| 1,604,448 | 10/1926 | Hosch | 415/213 R |
| 2,568,536 | 9/1951 | Beech | 415/213 R |
| 2,819,012 | 1/1958 | Atkinson | 415/213 R |
| 3,130,678 | 4/1964 | Chenault | 415/213 R |
| 3,155,046 | 11/1964 | Vaughan | 415/213 R |
| 3,246,605 | 4/1966 | Fisher | 415/213 R |
| 3,610,590 | 10/1971 | Kaelin | 416/185 |

FOREIGN PATENTS OR APPLICATIONS

| | | | |
|---|---|---|---|
| 189,315 | 12/1966 | U.S.S.R. | 416/185 |

*Primary Examiner*—Henry F. Raduazo
*Attorney, Agent, or Firm*—Paul Fitzpatrick

[57] ABSTRACT

A radial-flow turbomachine (centrifugal compressor or centripetal turbine) is provided with a lip extending along the free edge of each rotor blade from the inlet to the outlet end of the blade. The lip extends from the pressure face of the blade and serves to minimize leakage between the edge of the blade and the adjacent fixed shroud past which it is rotated.

3 Claims, 5 Drawing Figures

RADIAL-FLOW TURBOMACHINE

My invention is directed to the improvement of radial-flow turbomachines such as centrifugal compressors and centripetal turbines, and particularly to an improvement in the rotor blading of such machines to reduce leakage across the margins of the rotor blades and improve pressure distribution in the flow channels of the rotor.

Such radial-flow turbomachines are well known; both compressors and turbines of this type have rotors of generally similar appearance, in each case having an annular body defining the inner boundary of a flow path through the rotor. Blades extend radially and axially from the rotor body to define passages for flow of the fluid between the blades and over the face of the body. In the case of a compressor, the annular flow path is generally from axial or nearly so at the inlet outwardly to a generally radial discharge at the periphery of the rotor. In a turbine, the flow is opposite, with the motive fluid entering at the periphery of the rotor approximately radially, flowing inwardly, and exhausting generally axially. The curvilinear flow path between adjacent blades is ordinarily bounded by the rotor body and by a fixed shroud or casing within which the rotor rotates. There must be clearance between the edges of the blades and the fixed shroud, so there is leakage past the tips of the blades from one flow passage to another causing losses. Such losses may be prevented by fully enclosing the rotor passages by a rotating shroud of annular form which extends around the rotor in contact with the edges of the blades remote from the rotor body. This solution, however, creates other losses and is particularly disadvantageous in compressors and turbines for some purposes because of the large increase in moment of inertia of the rotor.

My invention is directed to obtaining in considerable measure the advantages of such a fixed shroud without the mechanical strength problems, increased moment of inertia, and other disadvantages of the totally shrouded centrifugal impeller or centripetal turbine wheel.

The nature of my invention may be outlined as stating that it involves the provision of a lip extending along the edge of the blades remote from the rotor body from the pressure surface of the blade; that is, the forward surface of the blade in a compressor, and the rear surface in a turbine.

The lip, which may be a narrow lightweight structure, acts to deflect the gas away from the gap between the edge of the blade and the adjacent fixed shroud, thus minimizing leakage and promoting improved velocity and pressure distribution in the rotor passages.

The principal objects of my invention are to improve the efficiency of radial-flow turbomachines, to minimize leakage between adjacent flow passages of such machines, and to improve the characteristics of flow through the rotor channels. A further object is to minimize leakage by the provision of a lip along the free edge of each rotor blade, the structure being such as to add very little to the moment of inertia of the rotor.

The nature of my invention and its advantages will be clear to those skilled in the art from the succeeding detailed description of preferred embodiments of the invention, the accompanying drawings thereof, and the appended claims.

Referring to the drawings.

Figure 1:
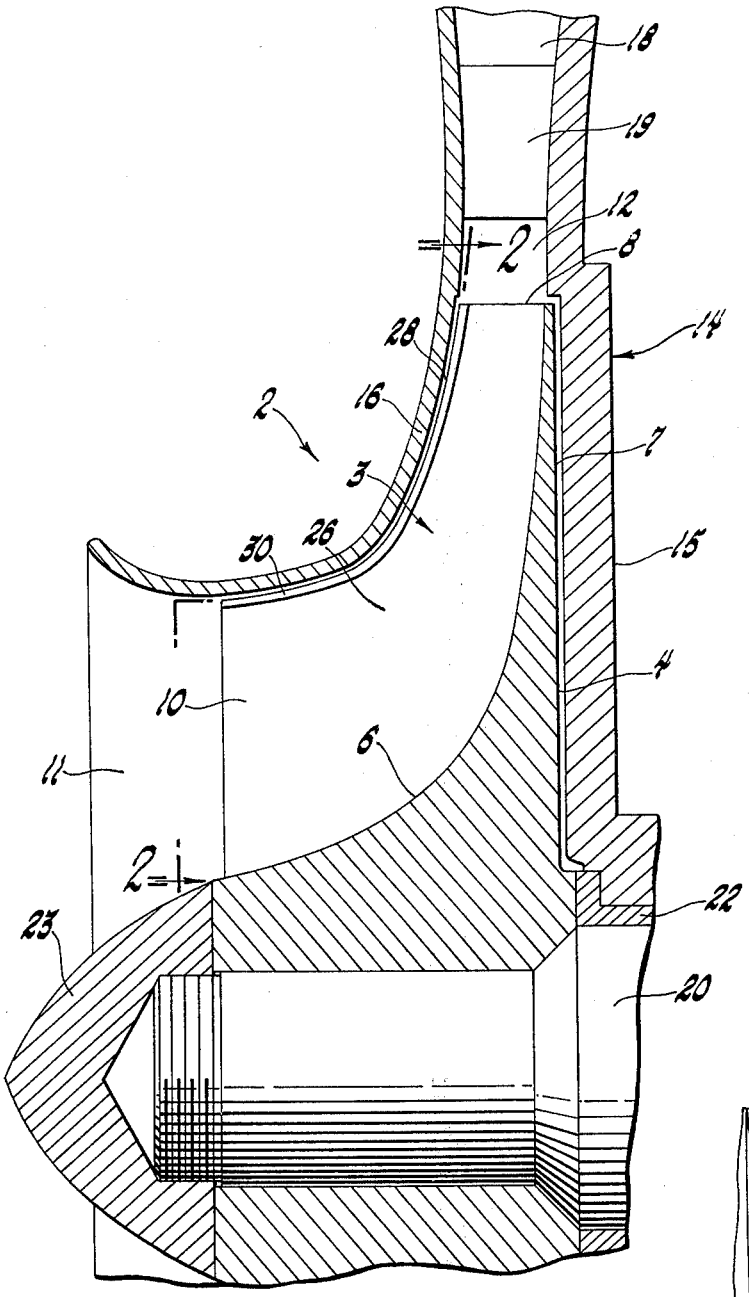
FIG. 1 is a sectional view, taken on a plane containing the axis of the rotor, of a centrifugal compressor embodying the invention.

Referring first to FIG. 1, a radial-flow turbomachine 2, which so far as it is illustrated might be either a centrifugal compressor or a centripetal turbine, is described as a compressor for clarity. The compressor includes a rotor or impeller 3. The rotor includes a body or wheel 4 which may for convenience in description be considered to consist of a central hub portion 6 and a disk portion 7 extending radially outward from the hub portion to the periphery of the rotor at 8. An annular array of impeller blades 10 extends radially from the hub and forwardly from the disk. These blades define passages between them through which air flows from an anular inlet or eye 11 into an annular vaneless space 12 adjacent the periphery of the impeller.

The impeller 3 is mounted in a compressor stator 14 comprising a rear plate 15 extending closely adjacent to the rear face of disk 7 and a front plate or rotor shroud 16. Shroud 16 bounds the outer or forward surface of the flow path through the impeller, and is fixed to the rear plate.

The outer portions of the rear plate 15 and front plate 16 define between them a diffuser 18 through which the air or other gas discharged from the impeller flows to a point of use, being decelerated and thus having its kinetic energy converted into pressure head in the diffuser as is well known. The diffuser may include vanes 19, indicated more or less schematically, although the diffuser could be vaneless. The vanes guide the flow from the vaneless space 12 through the diffuser to an outlet which is not illustrated.

Rotor body 4 is fixed to a shaft 20 mounted in a suitable bearing 22 in the rear plate 15. The rotor may be retained by a nut 23 threaded to the end of shaft 20 which also serves as a streamlined nose or bullet for the rotor hub. In the operation of such a compressor, the impeller 3 is rotated at high speed to pump the gas, which may be air, which is delivered from the impeller at high speed into the diffuser with a considerable radial component of velocity and a greater tangential component. The operation need not be further described, since it is well understood by those skilled in the art.

FIG. 1 can be regarded also as representing a centripetal turbine, in which case the vanes 19 would be nozzle vanes of the turbine to direct the flow into the rotor through which it flows inwardly and is discharged through the outlet at 11, the rotor driving shaft 20.

Figure 2:
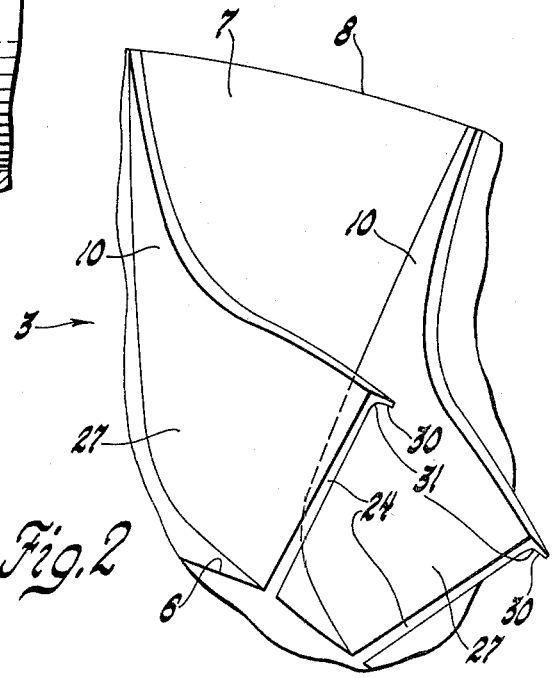
FIG. 2 is a partial elevation view of the rotor taken in the direction indicated by the line 2—2 in FIG. 1.

FIG. 2 shows a curvature of the blades 10 near the forward or inner edge 24. Thus is the inlet edge in a compressor and the discharge edge in a turbine. This curvature of the blades is to accelerate the fluid smoothly into a compressor, or to extract its rotational component of velocity as it leaves the rotor of a turbine. A compressor will rotate clockwise as viewed in FIG. 2, a turbine counterclockwise.

The turbomachine structure as described to this point may be regarded as conventional. Variations in structure may be made to follow usual practice in compressor or turbine design.

Those skilled in the art will recognize that the face 26 of each blade 10 which is to the right or clockwise as viewed in FIG. 2 is the higher pressure face in operation of either a turbine or a compressor, whereas the face 27 which is counterclockwise as viewed in FIG. 2 is the lower pressure face. For convenience, these will be referred to as the pressure and suction faces, although it will be realized that normally there will be pressure on the suction face, but less than that on the pressure face. Due to this pressure difference, there is a continual tendency for gas to leak through the gap 28 between the outer edge of the blade and the fixed shroud 16. In the case of a compressor, there is also such leakage due to the relative rotation of the blade and shroud, the shroud thus rotating relative to the blade and tending, as viewed from the rotor, to carry the gas through the passage 28. In the turbine, on the other hand, this particular effect is in opposition to the leakage due to differential pressure on the two sides of the blades.

With this introduction, we may proceed to a description of my improvement provided to minimize such leakage and improve uniformity of flow from the rotor into the diffuser in the case of a compressor or into the exhaust in the case of a turbine.

In accordance with my invention, a small lip or ridge 30 extends over the entire length of the free edge of the blade adjacent shroud 16. The inner surface of this lip may preferably be rounded or filleted as indicated at 31 in FIG. 2. The lip may be cast as an integral part of the rotor, if the rotor is cast. It could be formed on the blade by machining. Alternatively, a strip of metal may be welded or brazed to the outer edge of each blade. The lip 30 is of small extent and may be approximately from one to two times the thickness of the blade in its dimension perpendicular to the surface of the blade. The ridge projects circumferentially of the rotor and, extending from the pressure surface, it is on the forward surface of the moving blade in a compressor and on the rear surface of the moving blade in a turbine.

Figure 4:
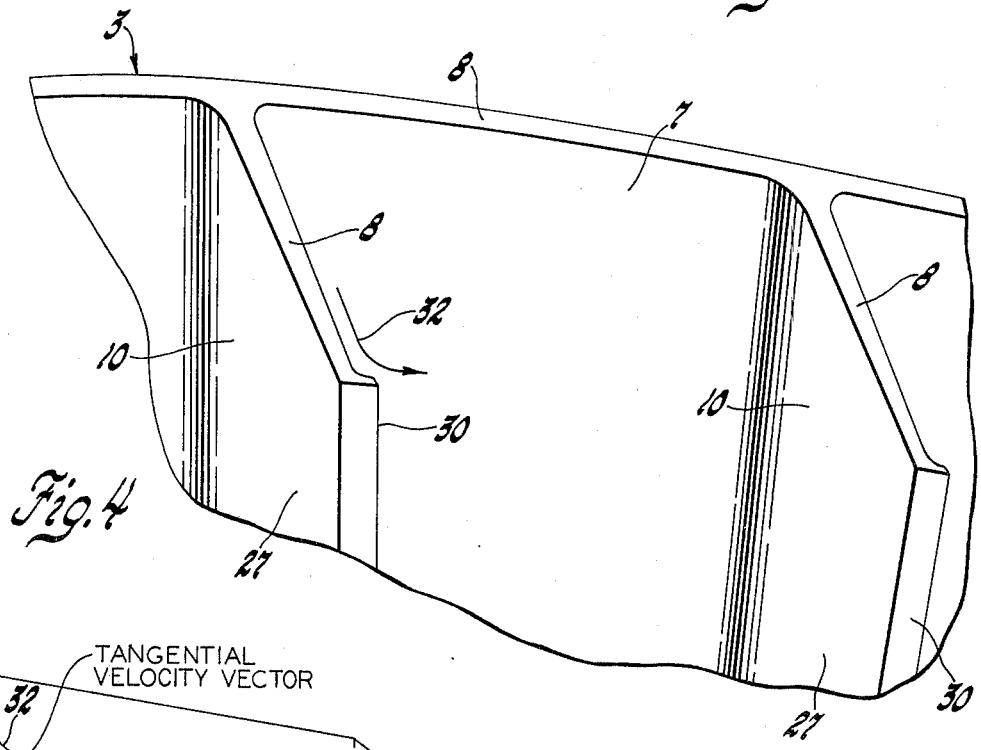
FIG. 4 is an enlarged view of a portion of FIg. 2, further showing a tangential velocity vector.

As illustrated in FIG. 4 by the arrow 32, there is an inherent tendency of the gas to flow in the direction away from the disk 7 and toward the edge of the blade at the pressure face in operation of the machine. The lip 30 of the invention diverts this flow from its axial direction relative to the rotor to a tangential direction which is toward the suction face of the blade defining the other boundary of the flow passage. The circulating gas thus is deflected away from the gap 28 between the edge of the blade and the shroud 16 and thus is less able to enter the gap. The added width of the gap is also of some effect in reducing leakage flow from the pressure face to the suction face.

Figure 3:
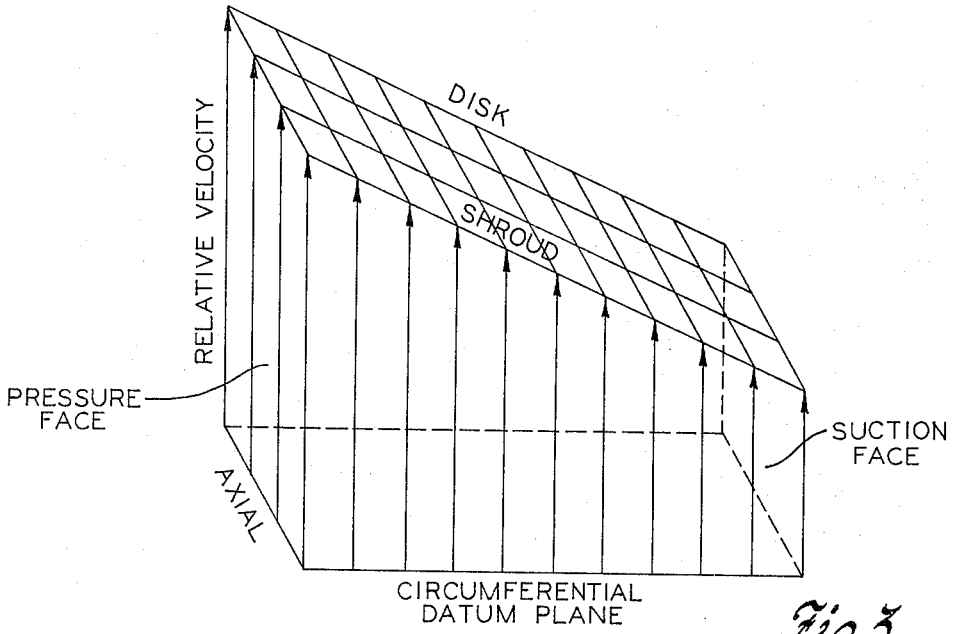
FIG. 3 is a three-dimensional diagram of typical flow distribution in a compressor lacking my invention.
Figure 5:
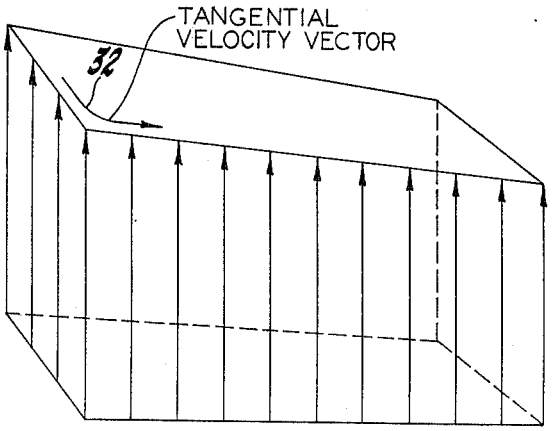
FIG. 5 is a view similar to FIG. 3 illustrating flow distribution in a compressor to which the lip seal of my invention has been added.

In addition to the reduction of leakage due to the rib 30, the recirculation away from the pressure face indicated by arrow 32 tends to reduce the unequal distribution of radial velocity in the flow passage. The effect of the lip on the distribution of velocity in the flow passages is illustrated by FIGS. 3 and 5. The legends applied to FIG. 3 apply also to FIG. 5 and, therefore, are not duplicated. The vertical arrows represent relative velocity, with the disk 7 at the rear of the three-dimensional plot and the shroud 16 at the front of the plot. The suction face of a blade is at the right and the pressure face of the blade bounding the other side of the passage is at the left. The direction axially of the rotor is from front to rear, and the circumferential direction is from right to left or left to right as indicated.

It will be seen that there is a somewhat greater velocity near the disk than near the shroud but, more importantly, there is a distinct disparity between the velocities adjacent the faces of the blades bounding the passage. When the lip as illustrated in FIGS. 1, 2 and 4 is applied, the tangential velocity vector 32 indicated in FIGS. 4 and 5 improves circulation from the pressure face towards the suction face, increasing velocity adjacent the suction face and reducing the velocity adjacent the pressure face. The resulting decreases in nonuniformity of velocity of flow improves the flow pattern into the diffuser and therefore the pressure recovery and efficiency of the compressor.

A similar effect occurs in a turbine in which, of course, the velocities are inward and forward rather than rearward and outward. In a turbine, the tendency is for the velocity to be greater along the pressure face and the circulation reduces the disparity so that the conditions at the exit; that is, at the point 11 as illustrated in FIG. 1, are more uniform and recovery of energy from the entering fluid is enhanced.

It will be seen that the application of the invention to the structure of a turbine or compressor rotor is a very simple matter. The lightweight lip adds no significant amount of inertia to the rotor, and puts no significant stress on the blades or the body of the rotor. In this respect it is greatly different from a continuous rotating shroud which is heavy and has high inertia and imposes high centrifugal stresses on the rotor.

The detailed description of the preferred embodiments of the invention for the purpose of explaining the principles thereof is not to be considered as limiting or restricting the invention, since many modifications may be made by the exercise of skill in the art.

I claim:

1. A radial-flow turbomachine including a rotor comprising a rotatably mounted body of circular cross-section having a hub portion and a disk portion extending radially from the hub portion, the disk and hub portions defining the inner boundary of an annular gas flow path through the rotor, the rotor also comprising an annular array of circumferentially spaced blades extending outwardly from the hub portion and forwardly from the disk portion, the blades extending from an annular gas inlet to an annular gas outlet and defining gas flow passages between them and being effective to transfer energy between the rotor and gas flowing through the passages, the blades each having a pressure face and a suction face in operation of the rotor, each blade having a free bounding edge remote from the rotor body extending along a course trending from near axial at one end of the gas flow passages to near radial at the other end of the gas flow passages, the turbomachine also including a stator enclosing the rotor and defining the gas inlet to and outlet from the rotor, the stator including a fixed rotor shroud extending continuously around the rotor closely adjacent to the free edges of the blades providing the outer boundary of the flow path through the rotor and acting to minimize leakage over the said free edges of the blades; wherein the improvement comprises a lip extending circumferentially of the rotor from the pressure face of each blade along the free edge of the blade with the outer surface of the lip extending closely parallel to the adjacent rotor shroud adapted to deflect gas flowing over the pressure face toward the said edge away from the pressure face toward the suction face of the blade at the opposite side of the passage and to obstruct leakage flow between the said edge of the blade and the rotor shroud into the adjoining passage.

2. A radial-flow compressor including a rotor comprising a rotatably mounted body of circular cross-section having a hub portion and a disk portion extending radially from the hub portion, the disk and hub portions defining the inner boundary of an annular gas flow path through the rotor, the rotor also comprising an annular array of circumferentially spaced blades extending outwardly from the hub portion and forwardly from the disk portion, the blades extending from an annular gas inlet to an annular gas outlet at the periphery of the rotor and defining gas flow passages between them and being effective to transfer energy from the rotor to gas flowing outwardly through the passages, the blades each having a pressure face and a suction face in operation of the rotor, each blade having a free bounding edge remote from the rotor body extending along a course trending from near axial at the gas inlet end of the blades to near radial at the gas outlet end of the blades, the compressor also including a stator enclosing the rotor and defining the gas inlet to and outlet from the rotor, the stator including a fixed rotor shroud extending continuously around the rotor closely adjacent to the free edges of the blades providing the outer boundary of the flow path through the rotor and acting to minimize leakage over the said free edges of the blades; wherein the improvement comprises a lip extending circumferentially of the rotor from the pressure face of each blade along the free edge of the blade with the outer surface of the lip extending closely parallel to the adjacent rotor shroud adapted to deflect gas flowing over the pressure face toward the said edge away from the pressure face toward the suction face of the blade at the opposite side of the passage and to obstruct leakage flow between the said edge of the blade and the rotor shroud into the adjoining passage.

3. A radial-flow turbine including a rotor comprising a rotatably mounted body of circular cross-section having a hub portion and a disk portion extending radially from the hub portion, the disk and hub portions defining the inner boundary of an annular gas flow path through the rotor, the rotor also comprising an annular array of circumferentially spaced blades extending outwardly from the hub portion and forwardly from the disk portion, the blades extending from an annular gas inlet at the periphery of the rotor to an annular gas outlet and defining gas flow passages between them and being effective to transfer energy to the rotor from gas flowing inwardly through the passages, the blades each having a pressure face and a suction face in operation of the rotor, each blade having a free bounding edge remote from the rotor body extending along a course trending from near radial at the gas inlet end of the blades to near axial at the gas outlet end of the blades, the turbine also including a stator enclosing the rotor and defining the gas inlet to and outlet from the rotor, the stator including a fixed rotor shroud extending continuously around the rotor closely adjacent to the free edges of the blades providing the outer boundary of the flow path through the rotor and acting to minimize leakage over the said free edges of the blades; wherein the improvement comprises a lip extending circumferentially of the rotor from the pressure face of each blade along the free edge of the blade with the outer surface of the lip extending closely parallel to the adjacent rotor shroud adapted to deflect gas flowing over the pressure face toward the said edge away from the pressure face toward the suction face of the blade at the opposite side of the passage and to obstruct leakage flow between the said edge of the blade and the rotor shroud into the adjoining passage.

* * * * *